US012233507B2

(12) United States Patent
Bosio et al.

(10) Patent No.: US 12,233,507 B2
(45) **Date of Patent: *Feb. 25, 2025**

(54) APPARATUS FOR CHANGING AN ABRASIVE SHEET IN AN ABRADING MACHINE

(71) Applicant: Fabrica Machinale S.R.L., Cascina (IT)

(72) Inventors: Luca Bosio, Pisa (IT); Renzo Valleggi, Pontedera (IT)

(73) Assignee: FABRICA MACHINALE S.R.L., Cascina (IT)

( * ) Notice: Subject to any disclaimer, the term of this patent is extended or adjusted under 35 U.S.C. 154(b) by 1401 days.

This patent is subject to a terminal disclaimer.

(21) Appl. No.: 16/739,961

(22) Filed: Jan. 10, 2020

(65) Prior Publication Data

US 2020/0147754 A1 May 14, 2020

Related U.S. Application Data

(63) Continuation of application No. 15/120,340, filed as application No. PCT/IB2015/051160 on Feb. 17, 2015, now Pat. No. 10,532,444.

(30) Foreign Application Priority Data

Feb. 20, 2014 (IT) ..... PI2014A000015

(51) Int. Cl.

| | |
|---|---|
| ***B24B 53/00*** | (2006.01) |
| ***B24B 23/03*** | (2006.01) |
| ***B24B 27/00*** | (2006.01) |
| ***B24B 41/00*** | (2006.01) |
| ***B24D 9/08*** | (2006.01) |

(52) U.S. Cl.

CPC ..... *B24B 53/00* (2013.01); *B24B 23/03* (2013.01); *B24B 27/0038* (2013.01); *B24B 41/00* (2013.01); *B24D 9/08* (2013.01); *B24D 9/085* (2013.01)

(58) Field of Classification Search

CPC ..... B24D 9/085; Y10T 483/179; Y10T 29/53961; B25J 15/0019; B25J 15/0433; B25J 15/0491; B25J 9/1664

USPC ..... 483/33, 54

See application file for complete search history.

(56) References Cited

U.S. PATENT DOCUMENTS

2016/0039067 A1* 2/2016 Bonnet ..... B24B 23/046 451/259

FOREIGN PATENT DOCUMENTS

| | | |
|---|---|---|
| DE | 202013101858 U1 | 5/2013 |
| EP | 2463056 A2 | 6/2012 |

* cited by examiner

*Primary Examiner* — Eric J Rosen
*Assistant Examiner* — Aaron R McConnell
(74) *Attorney, Agent, or Firm* — STEPTOE LLP; Carl B. Wischhusen

(57) ABSTRACT

A system for replacing an abrasive sheet in a sanding machine including a working head in which it is provided a support body having an engagement surface arranged to engage with an abrasive sheet. The sanding machine also includes a handling device arranged to actuate the support body in space according to at least two degrees of freedom. The system may include a computing device to compute the spatial orientation of the support body. Furthermore, the system may include a removal station having a gripping element configured to grip the abrasive sheet in order to disengage the abrasive sheet from the support body.

15 Claims, 15 Drawing Sheets

APPARATUS FOR CHANGING AN ABRASIVE SHEET IN AN ABRADING MACHINE

CROSS-REFERENCE TO RELATED APPLICATIONS

This application is a Continuation of U.S. patent application Ser. No. 15/120,340, which is a National Stage of International Application No. PCT/IB2015/051160, filed Feb. 17, 2015, which claims priority to Italian Patent Application No. PI2014A000015, filed Feb. 20, 2014, each of which is incorporated by reference in its entirety.

FIELD OF THE INVENTION

The present invention relates to sanding machines and, in particular it relates to an apparatus for changing an abrasive sheet in a sanding machine.

Furthermore, the invention relates to a method for carrying out a sandpaper change.

BACKGROUND

As well known, sanding, or abrading, is an operation that is made on surfaces of different materials, like plastic materials, metal materials, wood, for finishing the surfaces of objects of various type, normally for preparing them to next operations like painting their surface.

The abrading, or sanding step, is usually effected manually by an operator that grips a hand-held tool. This is usually equipped with an abrasive disc, usually a disc of sandpaper, which is moved by an electric motor, or by a compressed air motor, which rotates the support to which it is fastened.

Among sanding machines of last generation there are the orbital sanders, in which the motor causes an orbital movement to the abrasive disc. In this type of machines, the support rotates about a rotation axis and at the time describes an orbital path. This way, owing to the particular motion the abrasive disc can make high quality sanding of the worked surfaces.

There are also automatic machine tools in which the abrasive disc is moved with respect to the surface to work.

In all the abrading or sanding machines, after a certain number of working cycles it is necessary to replace the abrasive disc that unavoidably is worn by the work and then produces a much less effective abrading action.

The change of the abrasive disc is made manually with subsequent loss of time and with the risk of applying in an incorrect way the abrasive disc to the support, with displacement from a correct working position and possibility to affect negatively the working step.

In U.S. Pat. No. 5,231,803 a method is described for positioning, at the end of a working cycle, a support body and the abrasive disc mounted to it in a known position. Once placed the support body in the known position, operations of removal and change of the abrasive disc are provided when it is worn.

However, in U.S. Pat. No. 5,231,803 a procedure of verification is not provided for controlling that the disc has been actually mounted to the support body. Therefore, if for any reasons, the position of the working head in the loading station is wrong, or the abrasive disc is not engaged, or the discs in the loading station are finished, then the abrasive disc is not mounted to the support body, and the working head is moved to the surface to work causing damages. In fact, not only the work of the surface of the working surface is compromised, since the abrasive action is not provided, but the support body and the working head can be damaged during when they hit the surface of the working surface.

Other prior art solutions with similar drawbacks are described also in EP2463056 and DE20213101858.

SUMMARY

In general terms, various embodiments are directed to an apparatus for replacing an abrasive sheet in abrading or sanding machines, which makes automatic the change of the abrasive sheet.

In addition, various embodiments are directed to an apparatus that ensures a highly precise positioning of the abrasive sheet.

Embodiments are directed to an apparatus that speeds up the change of the abrasive sheet.

It is still a further feature of the various embodiments to provide a method for replacing an abrasive sheet in abrading or sanding machines.

These and other objects are achieved by an apparatus or system, for changing an abrasive sheet in a sanding machine. In one embodiment, the system includes a sanding unit with a support body having an engagement surface arranged to engage the abrasive sheet. The sanding unit also includes a handling device configured to handle spatially the support body according to at least two degrees of freedom. The system also includes a removal station where the sheet can be removed from the support body. In one embodiment, the removal station includes a removal device having a sharp edge.

The handling device is arranged to actuate the support body with respect to the removal device to place the support body in a removal position in which the sharp edge is located between the abrasive sheet and the support body to detach at least one portion of the abrasive sheet from the engagement surface. In one embodiment, a detection device is provided which is arranged to measure the presence of the abrasive sheet on the engagement surface of the support body.

Preferably, the engagement surface has mutual engagement means of removable type with a side of the abrasive sheet facing, in use, towards the support body.

For example, the mutual engagement means can provide a layer of Velcro, i.e. a velvet layer on a face and a plurality of hooks on the other face, or an adhesive layer, in particular of reversible glue layer, a plurality of projections and recesses mutually engageable with each other, or a combination thereof.

Advantageously, the removal device is also comprised of a gripping element arranged to grip the abrasive sheet at the detached portion and to cause a relative movement between the gripping element and the support body determining a full disengagement of the abrasive sheet from the support body.

In a possible exemplary embodiment, the sharp edge is curvilinear, for example with substantially circular shape.

Advantageously, starting from a ready-for-removal position, the handling device is arranged to actuate the support body with respect to the sharp edge in order to cause the disengagement of a plurality of points of the abrasive sheet from the engagement surface. This way, a detached portion of the abrasive sheet from the support body is obtained assisting, thus a following full detachment.

In particular, the removal station has a gripping element arranged to grip the abrasive sheet at the detached portion, obtaining a gripping configuration. In this gripping configuration, a relative movement between the gripping element and the handling device causes the full disengagement of the abrasive sheet from the support body.

Preferably, the detection device is arranged at the removal station.

In particular, the detection device can be a sensor of colour recognition, i.e. a sensor responsive to a variation of the colour. In this case, therefore, the abrasive side of the abrasive sheet is of a colour different from the engagement surface of the support body. Therefore, according to the colour detected, the sensor of colour recognition can detect the presence, or the absence, of the abrasive sheet on the support body.

In one embodiment, the detection device is a diffuse-type laser sensor.

Furthermore, in a possible embodiment, in the removal station, can be provided a delivery member of a jet of a pressurized gas. The delivery member may be arranged to deliver the jet of a pressurized gas on the engagement surface of the support body, in order to remove possible dust and fragments of abraded material from a working surface.

In another exemplary embodiment, the apparatus also includes at least one application station at which an abrasive sheet is mounted to the engagement surface of the support body. In particular, at the application station at least one container is arranged to contain at least one abrasive sheet, the handling device may be arranged to position the support body at said container, in order to cause the engagement of an abrasive sheet with the engagement surface of the support body.

Preferably, in the container a push element is provided to push the abrasive sheet against the engagement surface of the support body previously positioned at said container, to assist the engagement of the abrasive sheet with the engagement surface.

In an exemplary embodiment, the support body has at least one main suction hole in pneumatic connection with an air suction system, in order to cause the suction from the environment of surrounding dust and fragments removed from the working surface. Preferably, in this case, also the abrasive sheet has at least one secondary suction hole that may overlap the main suction hole.

Preferably a computing device is provided for computing the spatial orientation of the support body to assist positioning the support body in a position having a known spatial orientation.

In one embodiment, the handling device is arranged to position the support body at the device for computing the orientation with the support body free to rotate about a rotation axis. In particular, the spatial orientation computing device includes an actuation member that is arranged to cause a rotation of the support body about its rotation axis to place the support body in the position having known spatial orientation.

In a possible exemplary embodiment, the actuation member includes at least one roller arranged to rotate about a rotation axis and configured to contact the engagement surface at a distance from the rotation axis of the support body equal to the radial distance of the main suction hole. The rotation of the roller causes a rotation of the support body about the rotation axis until the roller moves to a respective suction hole. The actuation member also includes a motor and a transmission member. The transmission member is arranged to transmit the movement of the motor to the roller for causing it to rotate about the rotation axis.

In an exemplary embodiment, the handling device has a working head at which the abrasive sheet engages the working head has an axis.

In particular, the sanding machine can be of roto-orbital type where the support body can rotate about its axis and can move along an orbital eccentric path with respect to the axis of the working head.

In this case, a device for computing the position of the rotation axis of the support body with respect to the axis of a working head of the handling device at which the abrasive sheet engages is provided to calculate the space position of the rotation axis knowing the position of the axis, in such a way that the handling device can handle spatially the support body in a precise way.

In particular, the device for computing the position of the axis of the support body is arranged to determine the distance of the axis of the support body from the axis of the working head. This solution can be provided, for example, because the space position of the axis of the working head is known. For example, the device for computing the position of the axis of the support body can be configured to position the support body in a limit position, at which the distance of the axis of the support body with respect to the axis of the working head is maximum. For example, the device for computing the position of the rotation axis is configured to position the support body at a position where the axis of the support body is at a maximum distance from the axis of the working head. Since the maximum distance, i.e. the eccentricity, is known and since it is possible to know instant-by-instant the position in space of the working head owing to position sensors, it is possible to determine also the position in space of the axis of the support body.

In one embodiment, if the support body and the abrasive sheets have main and secondary suction holes, respectively, the container of the application station has a reference element, in particular a reference bolt. More in detail, the reference element is arranged to engage with one of the suction holes of the support body, in order to keep the support body to a correct position during the application of the abrasive sheet.

Preferably, the container has a cover arranged to pass from a closed position of the container in order to avoid that dust and other material can make dirty a new abrasive sheet, and an open position, in which the abrasive sheet can exit from the container for application to the support body.

In one embodiment, the wall of the container—is associated with at least one protruding element towards the housing in which the stack of abrasive sheets is arranged. The latter are arranged in the container with respective abrasive sides facing each other and, accordingly, two sheets could adhere to each other and could be erroneously applied together to the support body. The presence of the protruding elements, instead, provides a separating action of the two sheets and avoids the disadvantage.

In particular, the protruding element can be a knurled, or indented, for example threaded.

According to another embodiment, a method for changing an abrasive sheet in a sanding machine is described. The method includes a sanding machine having a support body with an engagement surface arranged to engage with said abrasive sheet. The sanding machine also has a handling device configured to handle spatially the support body according to at least two degrees of freedom.

The method further includes providing a removal device having a sharp edge. Also, the method includes handling by the handling device the support body with respect to the removal device to place the support body in a removal position in which the sharp edge is located between the abrasive sheet and the support body. This detaches at least one portion of the abrasive sheet from the engagement surface. The method also includes controlling the presence of the abrasive sheet on the engagement surface of said support body.

BRIEF DESCRIPTION OF THE DRAWINGS

The various embodiments will be now shown with the following description of an exemplary embodiment thereof, exemplifying but not limitative, with reference to the attached drawings in which.

DETAILED DESCRIPTION

Figure 1:
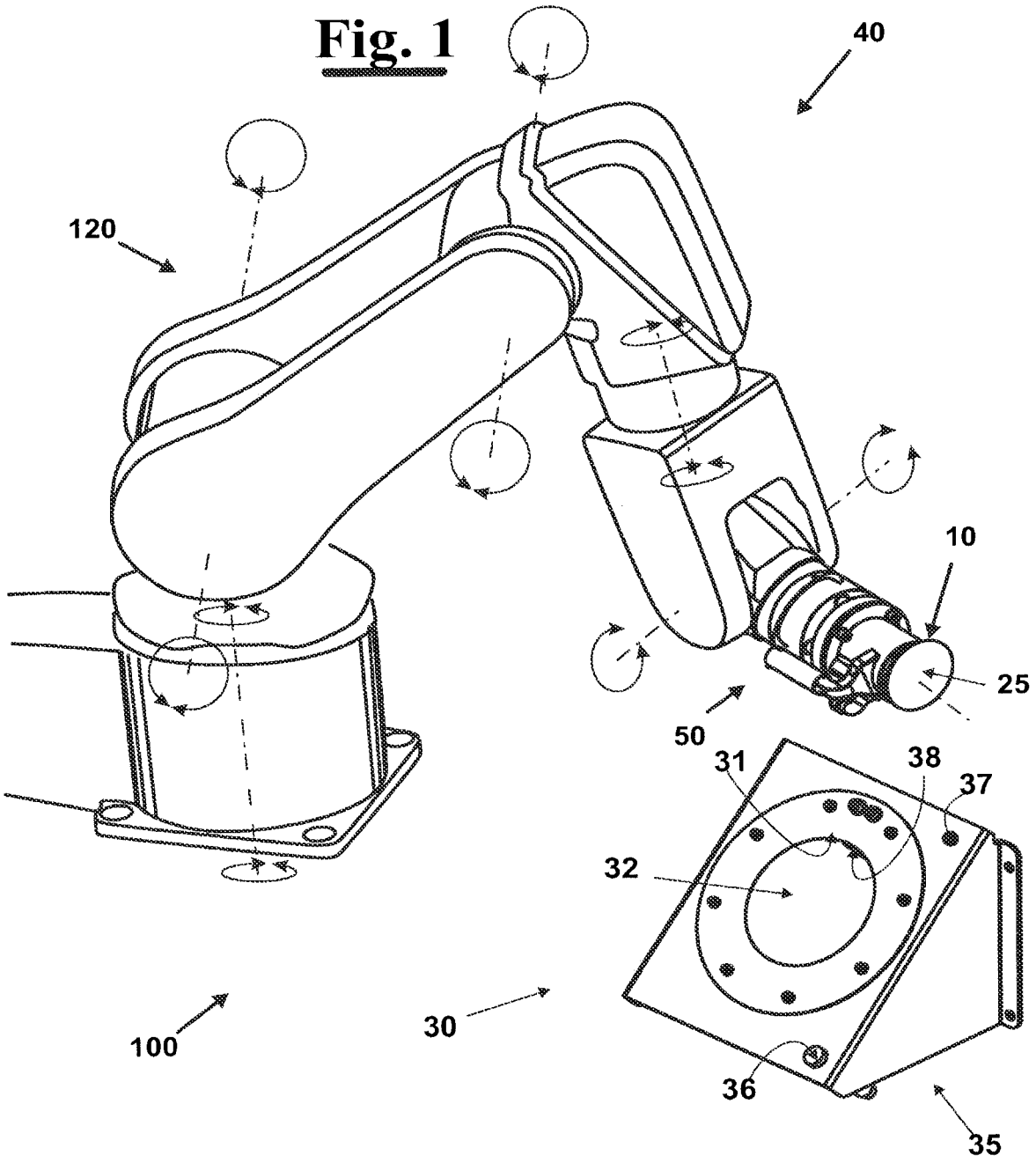
FIG. 1 diagrammatically shows a perspective view of a possible exemplary embodiment of an apparatus, according to the invention, for changing an abrasive sheet in a sanding machine.
Figure 2:
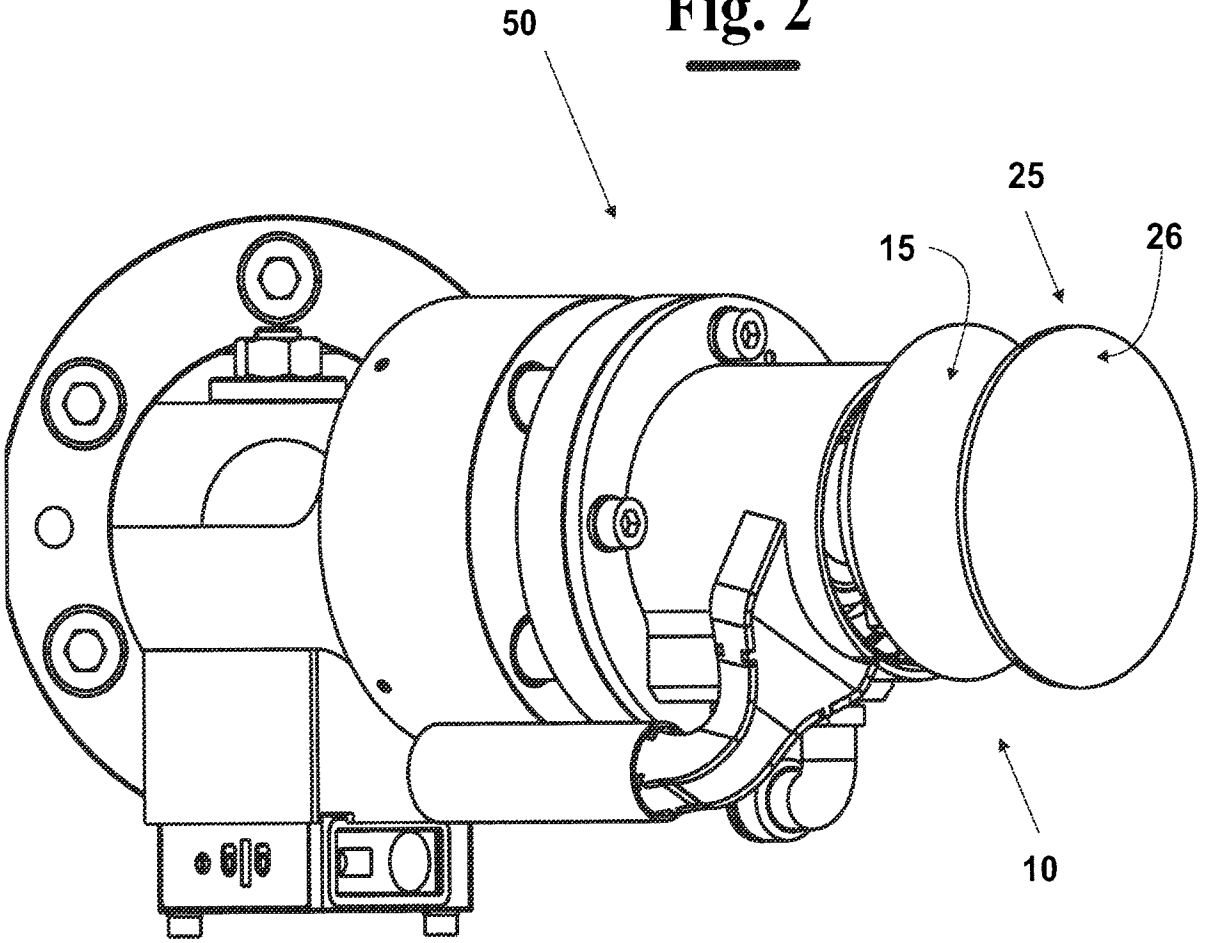
FIGS. 2 and 3 diagrammatically show a perspective elevational side view and in a side view, respectively, of a working head that can be associated with the apparatus of FIG. 1 to which is constrained the support body that causes the abrasive sheet.
Figure 3:
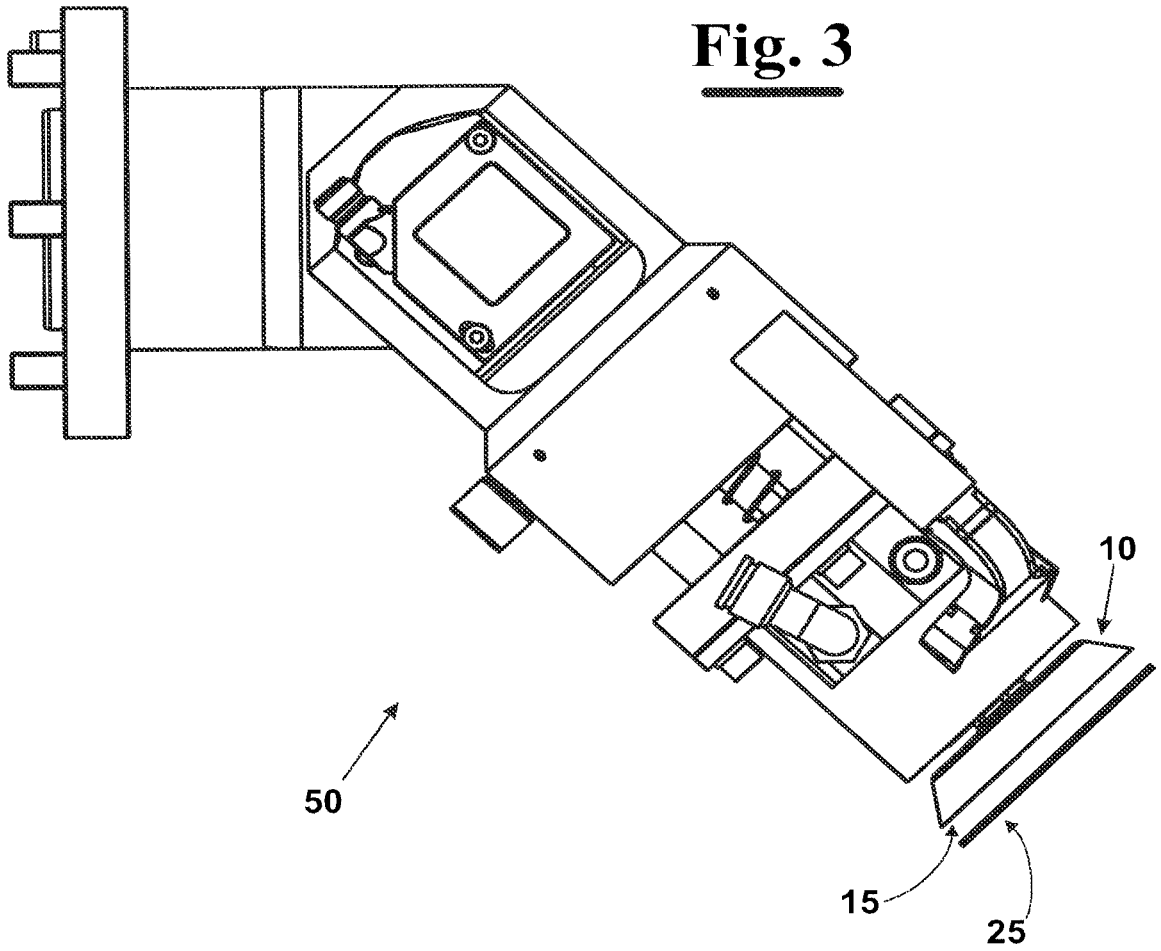

In FIG. 1, an apparatus is diagrammatically shown 100, according to the invention, for replacing an abrasive sheet 25 in a sanding machine 120. It comprises a working head 50 in which a support body 10 is provided having an engagement surface 15 arranged to engage with an abrasive sheet 25. The support body 10 has normally at least one rotation movement about a rotation axis 110 with respect to the working head 50. The sanding machine 120 can also be of roto-orbital type and therefore in this case, in operating conditions, the support body 10 describes an orbital eccentric path with respect to an axis 150 of the working head 50.

The sanding machine 120 also comprises a handling device 40 arranged to handle spatially the support body 10 according to at least two degrees of freedom. As diagrammatically shown in FIG. 1, the handling device 40 can be an anthropomorphic robot, for example with six rotational degrees of freedom.

Normally, the side 26 of the abrasive sheet 25 facing, in use, the support body 10 and the engagement surface 15 of the latter comprise a mutual engagement means of removable type. For example, the mutual engagement means can provide a layer of Velcro, i.e. a velvet layer on a face and a plurality of hooks on the other face, or an adhesive layer, in particular of reversible glue layer, or a plurality of projections and recesses mutually engageable with each other, or similar engagement elements.

According to the invention, the apparatus 100, in addition to the sanding machine as described above, comprises a removal station 30 in which a removal device 35 is installed having an sharp edge 31 arranged to remove the sheet 25 from the support body 10 through the operations described below. More in detail, the handling device 40 is arranged to position the support body 10 in a removal position in which the sharp edge 31 is located between the abrasive sheet 25 and the support body 10.

Through this step the mutual engagement means that engage the face 26 of the abrasive sheet 25 and the engagement surface 15 of the support body 10 and pass, at least at the beginning, from an engagement configuration to a configuration of disengagement in which at least one portion of the abrasive sheet 25 does not adhere any more to the engagement surface 15.

More in detail, once arranged the support body 10 in a ready-for-removal position, i.e. the first position, in which the support body 10 has at least one portion located opposite to the abrasive sheet 25 with respect to the sharp edge 31, the handling device 40 can actuate the support body 10 with respect to the sharp edge 31, in order to bring the sharp edge 21 between the support body 10 and the abrasive sheet 25 at a plurality of points. This way, a detached portion of the abrasive sheet from the support body 10 is obtained, comprising all the points of the abrasive sheet 25 detached from the engagement surface 15 of the support body 10.

Figure 4:
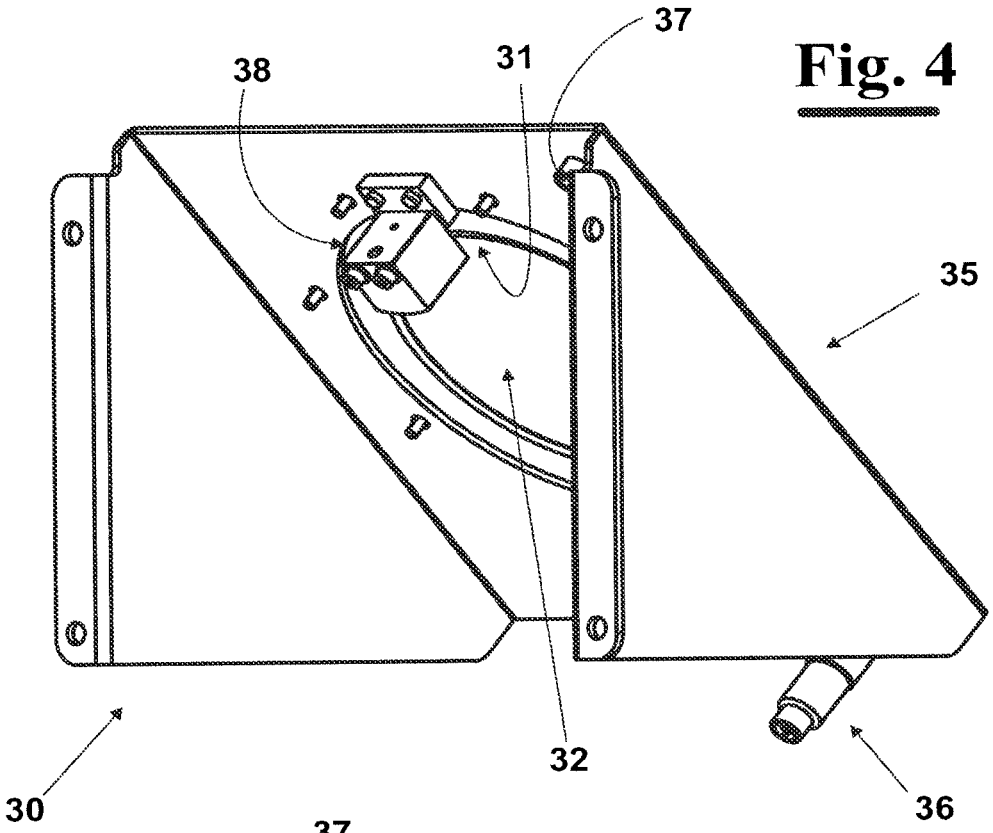
FIGS. 4 to 6 show a perspective rear view of an elevational side view of and in a perspective front view, respectively, a device for removing the abrasive sheet for highlighting some technical features.
Figure 6:
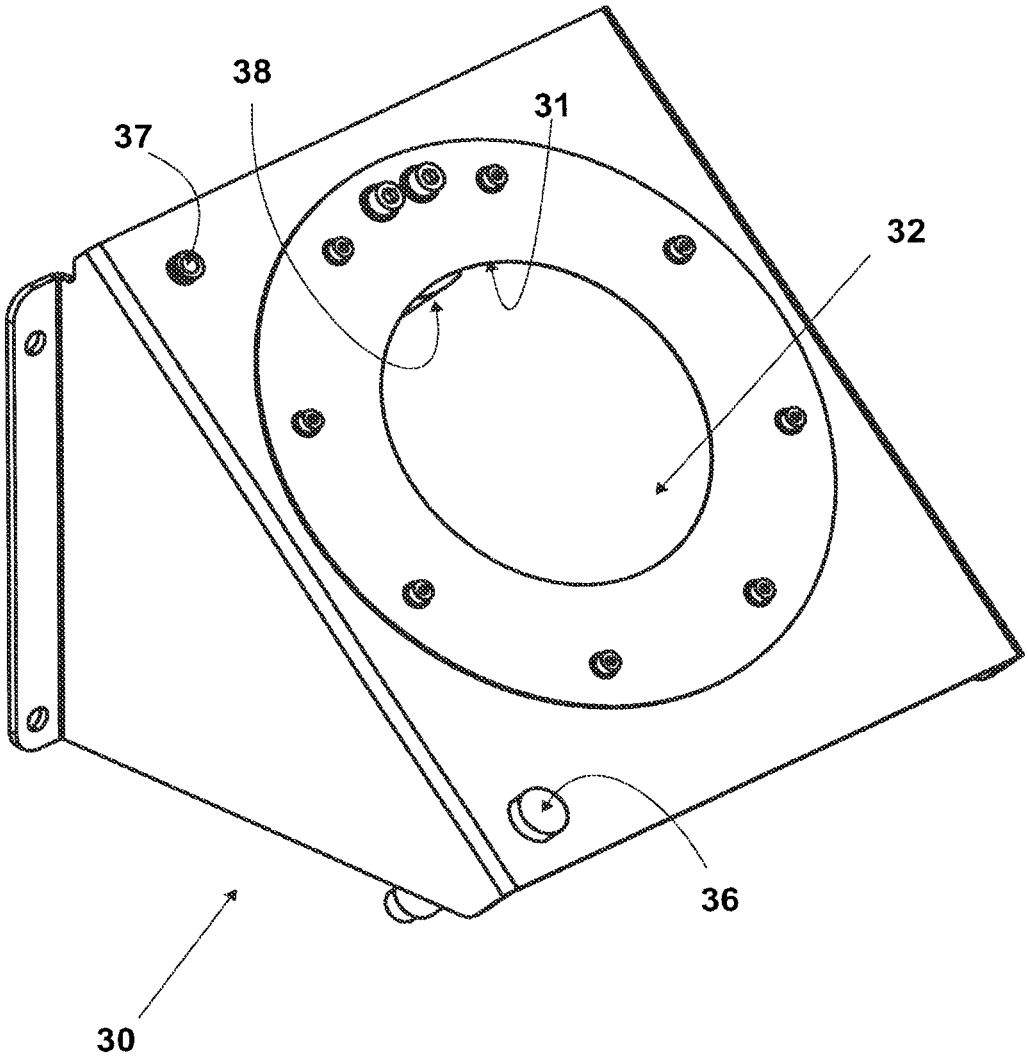

In the exemplary embodiment of FIGS. 1, 4 and 6, the sharp edge 31 is circular, but it may also have different shape, for example substantially linear, or it can have an open curved profile, or a combination of linear and curved segments.

In case of a sharp edge 31 having substantially circular shape, the support body 10 can be advantageously moved by the handling device 40 along a substantially circular trajectory, or elliptical, such that a disengagement of more points of the abrasive sheet 25 from the support body 10 is obtained.

The removal station 30 is, advantageously, equipped with a gripping element 38 arranged to grip the abrasive sheet 25 at the detached portion. In particular, in this case, the handling device 40 is arranged to position the abrasive sheet 25, advantageously the detached portion thereof, at the gripping element 38. When the gripping element 38 is arranged in the gripping configuration in which it grips the sheet 25, a relative movement between the gripping element 38 and the support body 10, for example made by the handling device 40, causes a full disengagement of the abrasive sheet 25 from the support body 10. In the example shown in FIGS. 4 and 5, the gripping element 38 comprises two parts and precisely a first part 38*a* and a second part 38*b* movable with respect to each other. For example, the part 38*a* can be connected to the removal device 35 and the part 38*b* can be slidingly mounted towards/away from the part 38*a*, for example along a direction substantially orthogonal to the plane on which the sharp edge 31 lays.

The removal station 30 can also have a device for detecting the presence of the abrasive sheet 25 on the engagement surface 15 of the support body 10. For example, the detection device can be a sensor of colour recognition 36, i.e. sensing the variation of the colour. In this case, the abrasive side 26 of the abrasive sheet 25 is of a colour different from the engagement surface 15 of the support body 10. Therefore, the sensor of colour recognition 36 can recognize the presence, or the absence, of the abrasive sheet 25 on the support body 10 according to the detected colour. The sensor 36 can also be a sensor of different type, normally a presence sensor.

The removal station can also be equipped with a delivery member 37 of a jet of air, or other pressurized gas, arranged to deliver the jet on the engagement surface 15 of the support body 10, once removed the abrasive sheet 25, for removing possible dust and fragments of abraded material from the working surface.

The apparatus 100 can also comprise at least one application station 70 in which an abrasive sheet 25' is mounted at the engagement surface 15 of the support body 10. At the application station 70 of the abrasive sheet at least one container 75 is arranged, containing at least one abrasive sheet 25, but preferably a stack of abrasive sheets 25. More in particular, the handling device 40 is arranged to position the support body 10 at the container 75 up to cause the engagement of an abrasive sheet 25 with the engagement surface 15 of the support body 10.

More in detail, at the application station 70 several containers 75 can be provided, for example each containing a sheet 25, or, more in general a stack of abrasive sheets 25 that have a different sand size, i.e. smaller or larger, and then used for a variety of Works, or for different sanding steps.

Figure 9:
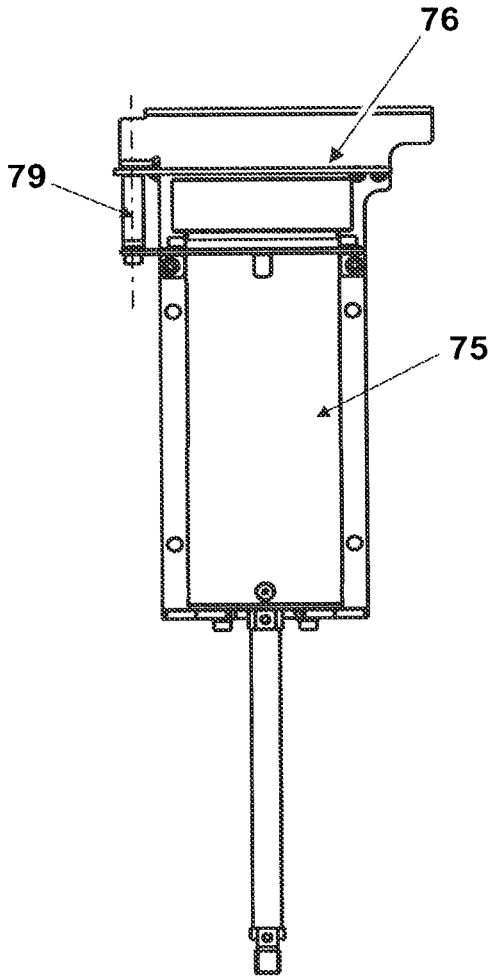
FIGS. 9 and 10 show an elevational front view of a container of abrasive sheets with a cover—in a closed configuration and in an open configuration, respectively.
Figure 10:
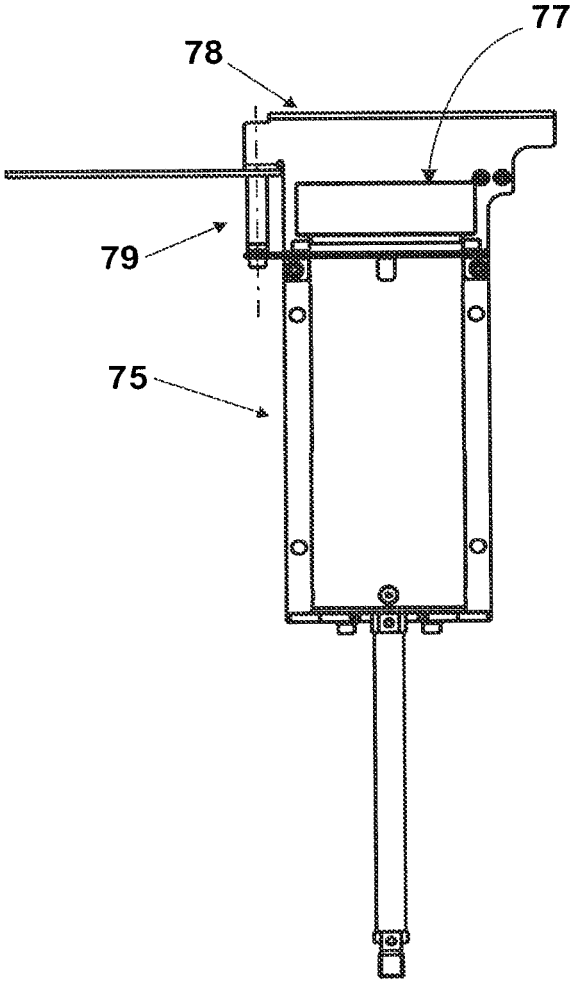
Figure 11:
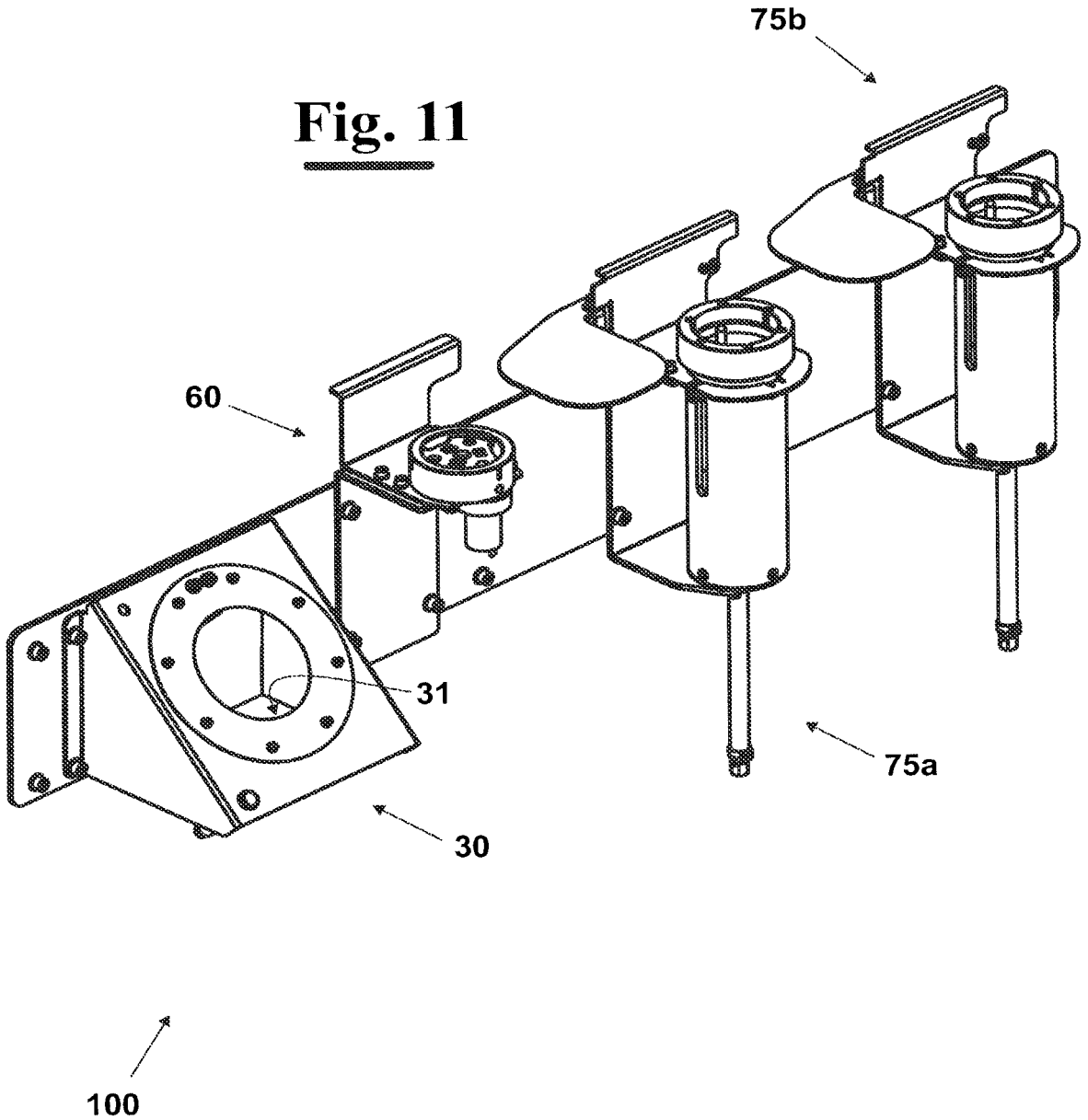
FIG. 11 shows a perspective view of a possible exemplary embodiment of the apparatus, according to the invention, in which a removal station, a station of computing the spatial orientation of the support body and an application station of the abrasive sheets are provided.
Figure 12:
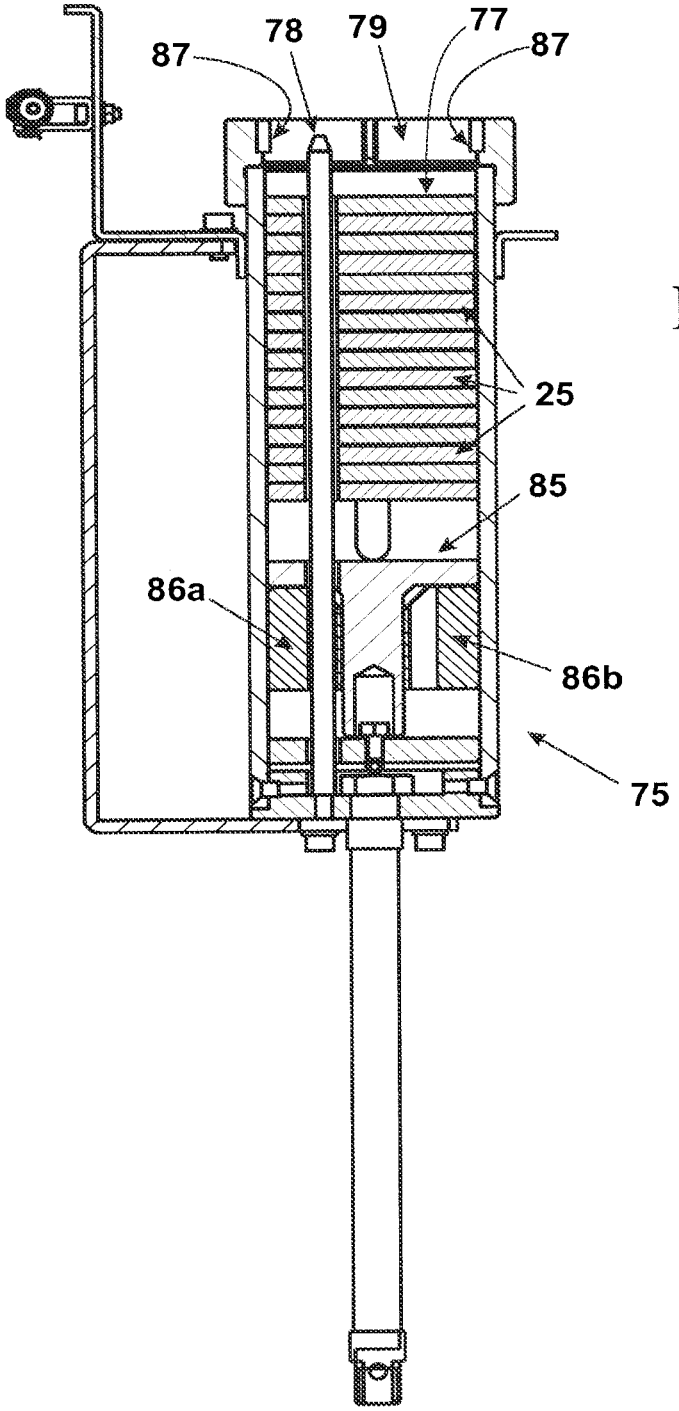
FIG. 12 shows in a cross section longitudinal view a particular exemplary embodiment of the container of FIG. 7.

The or each container 75 has a cover 76 arranged to pass from a closed position of container 75, in order to avoid that dust and other material can make dirty the abrasive sheets 25 (FIG. 9), to an open position, in which it allows the access of the support body 10, moved by the handling device 40, to the mouth 79 of the container 75, for being able, then, to apply a sheet 25 to the support body 10 (FIG. 10).

In the container 75 a push element can be provided of arranged to push the abrasive sheet 25, or the stack of sheets 25, towards the opening 79, in order to push the abrasive sheet 25 against the engagement surface 15 previously positioned at the opening 79. For example, the push element can be an actuator, such as a pneumatic piston 85, arranged to translate longitudinally in the container 75, and to act on a support body on which the abrasive sheets 25 are arranged, or directly on the first abrasive sheet 25 of the stack, i.e. farther from opening 78.

The actuator 85 can be associated with at least one stop element, for example two stop elements 86*a* and 86*b*, arranged to stop the withdrawal during a step of back stroke towards the starting position after having applied the abrasive sheet 25 to support body 10.

According to a further aspect of the invention, the wall 77 of container 75 has at least one protruding element 87, for example at opening 79. The protruding element 87 is arranged to protrude towards the inside of the container 75, i.e. in a recess 77, and is configured to cause the separation of two abrasive sheets 25 that can adhere to each another. The abrasive sheets 25, in fact, are arranged in the container 75 with the abrasive side of one sheet oriented towards the engagement side of the next one and, accordingly, the two sheets can adhere to each other and could erroneously applied together to the support body 10, with subsequent waste of material and with the risk of affecting the sanding step. The presence of the protruding elements 87, instead, produces an action of separating the two sheets 25 that can adhere to each other and allows, therefore, to avoid said disadvantage. In particular, the protruding element 87 can be a knurled element, or indented, for example having a screwed surface. Therefore, when translating the abrasive sheets 25 towards the support body, the protruding element 87 separates by friction the two abrasive sheets 25.

Figure 13:
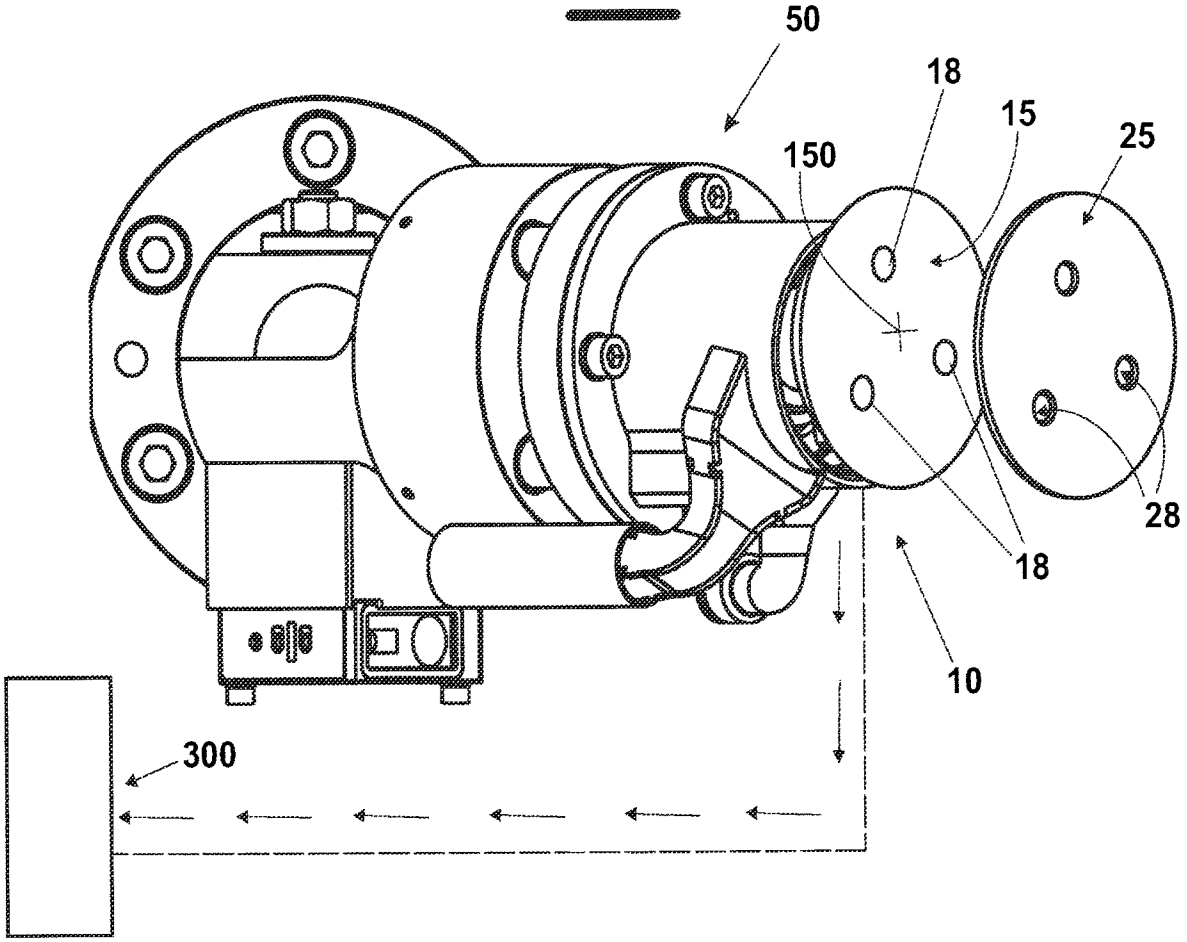
FIG. 13 shows a perspective elevational side view of an exemplary embodiment of the support body and of the abrasive sheet of FIG. 2.
Figure 14:
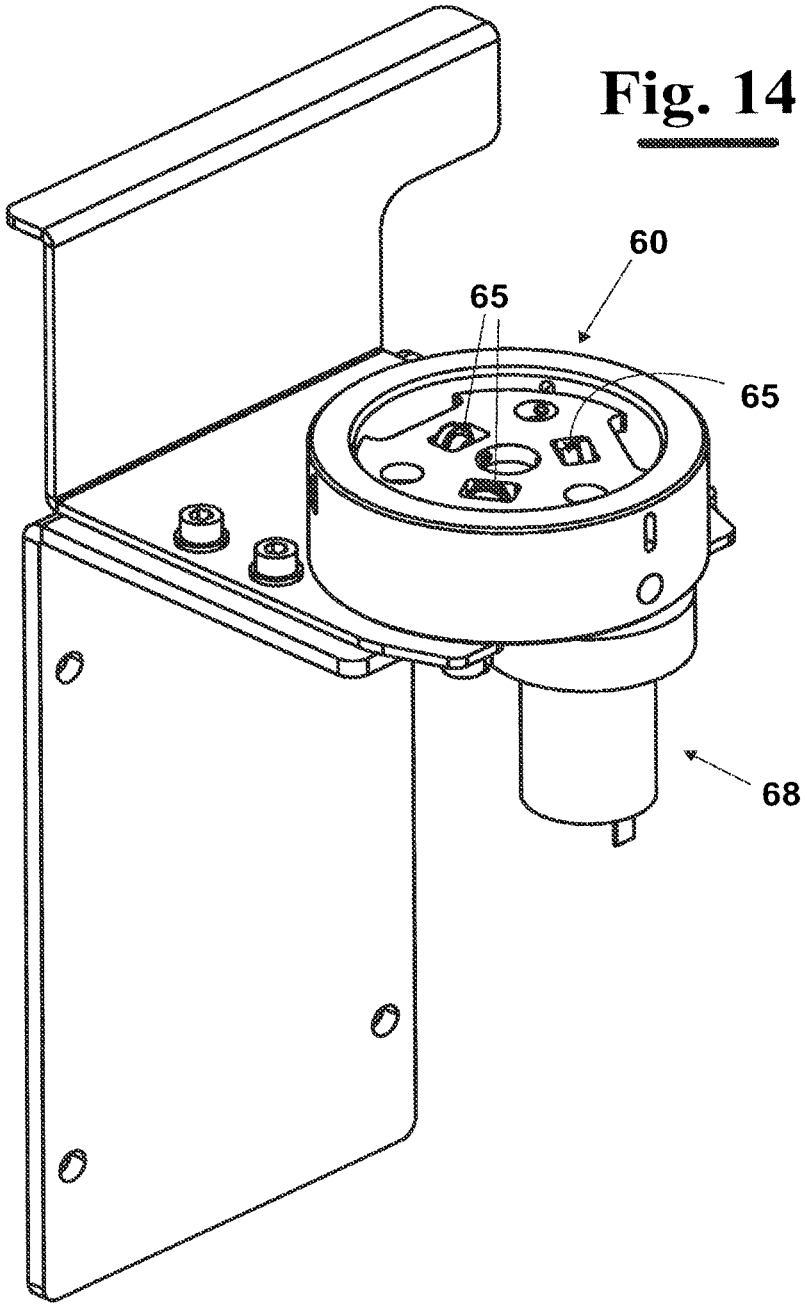
FIG. 14 shows a perspective elevational side view of a station of computing the spatial orientation of the support body.
Figure 15:
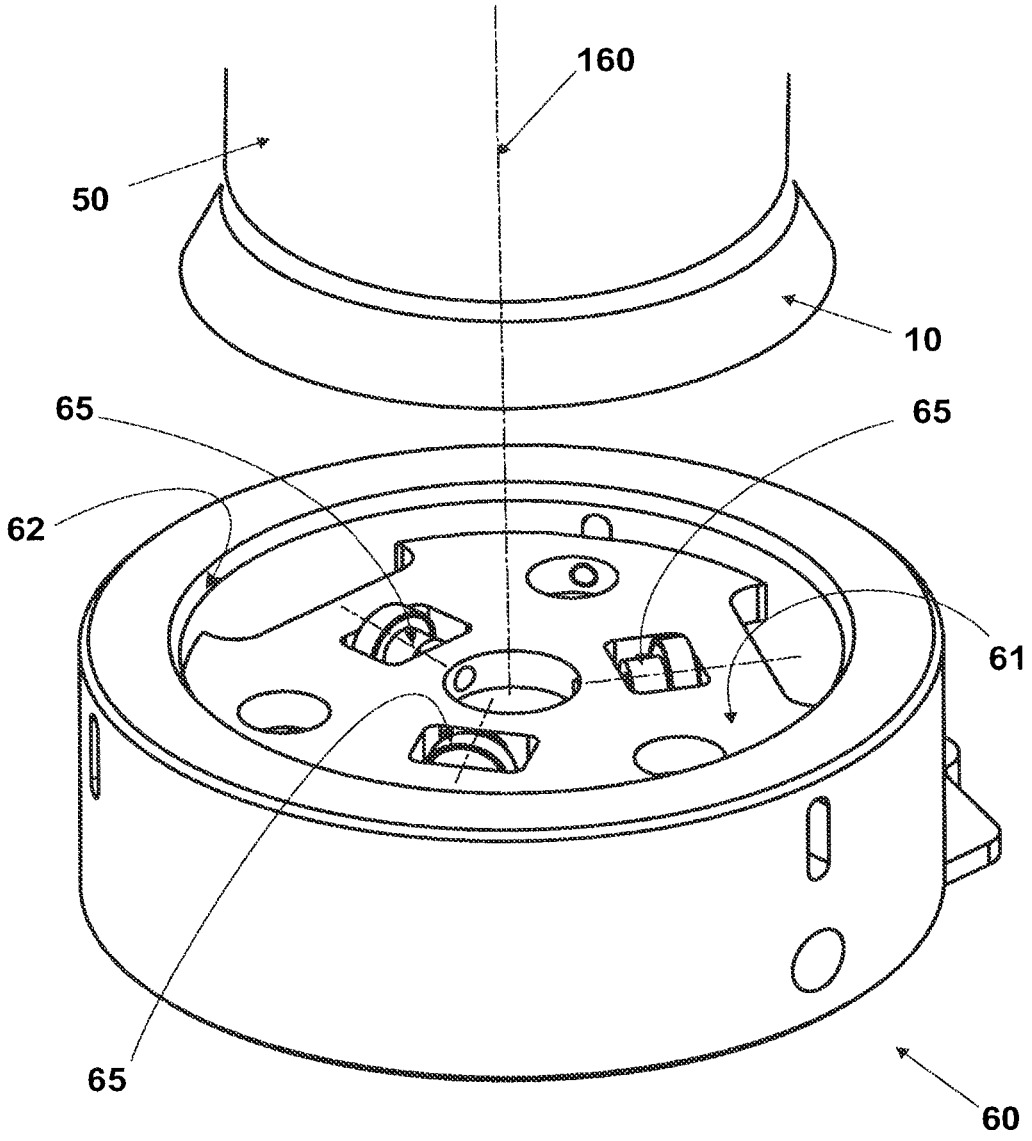
FIG. 15 shows in a perspective elevational front view the working head FIG. 13 during a step of approaching the station of computing the spatial orientation of the support body of FIG. 14 for arranging the support body on the rollers.

In the exemplary embodiment shown for example in FIG. 13, the support body 10 has at least one main suction hole 18, for example three suction holes 18 at an angle of 120° from one another. The or each main suction hole 18, is in pneumatic connection with an air suction system diagrammatically shown in FIG. 13 with a block 300. This way, when sanding a workpiece it is possible to cause the suction from the environment of surrounding dust and fragments from the working surface ensuring, on the one hand, to possible operators in the working area to work in safety conditions and, on the other hand, to avoid that dust and fragments material removed by the working surface can affect the sanding step.

Also the abrasive sheet 25 can be advantageously equipped with at least one secondary suction hole 28. In this case, therefore, it is necessary to provide a device for overlapping the, or each, main suction hole 18 with the, or a respective, secondary suction hole 28.

Alternatively, or in addition, to the device for overlapping, a computing device can be provided for determining the spatial orientation of the support body 10. More in detail, the spatial orientation computing device of the support body 10 is arranged to position the support body 10 to a position whose orientation is known.

An example of spatial orientation computing device of the support body 10 is shown in FIGS. 14 to 17.

The handling device 40 is configured to position the support body 10 at the device for computing the orientation 60 in such a way that the support body 10 is free to rotate about its own rotation axis 110. In particular, the handling device 40 is arranged to position the support body 10 with the engagement surface 15 in contact of rollers 65, whose operation is disclosed in detail hereinafter. The device 60 can provide a side wall 62 to define laterally a housing 61, to avoid possible side movements of the support body 10 during the step of computing the spatial orientation.

The spatial orientation computing device 60 comprises an actuation member 63,64 and 65, arranged to cause the rotation of the support body 10 up to bring it in a position whose spatial orientation is known. The actuation member for causing the rotation of the support body 10 can rotate the support body 10 up to place the suction holes 18 in a predetermined angular known position. Therefore, when the handling device 40 draws the support body its spatial orientation and, in particular the angular position of the holes 18, is known with precision. This allows moving in the application station 70 above described with the reliability of overlapping precisely the secondary suction holes 28, i.e. those made on the abrasive sheets 25, with the main suction holes 18, i.e. those of the support body 10.

In a possible exemplary embodiment, the device 63,64,65 is arranged to cause the rotation of the support body 10 about its rotation axis 110 up to a known position, comprising an element of transmission 63 arranged to transmit the movement of a motor, or a gear motor 66, to at least one roller 65 at a distance from the rotation axis 110 of the support body 10 corresponding to the radial distance of one of the main suction holes 18. More in detail, the roller 65 can rotate about an axis 165, for example substantially horizontal. The rotation of the roller 65 causes the rotation of the support body 10 positioned on it. For increasing the grip of the surface of the or each roller 65 on the engagement surface 15 of the support body 10 it is possible to provide that the roller surface is knurled, or indented. When the rotation of the support body 10 has brought the roller 65 at the suction hole 18, the rotation of the support body 10 stops.

Figure 17:
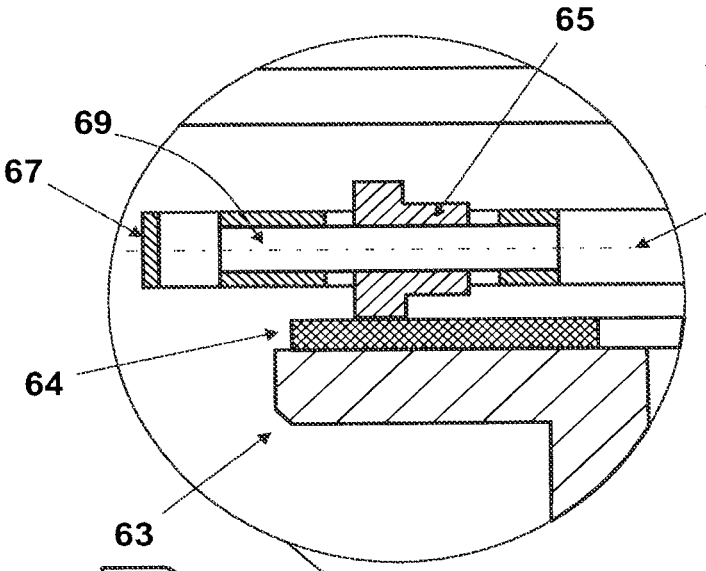
FIG. 17 shows an enlarged view of a portion of the spatial orientation computing device of the support body of FIG. 16 for highlighting some structural features.
Figure 16:
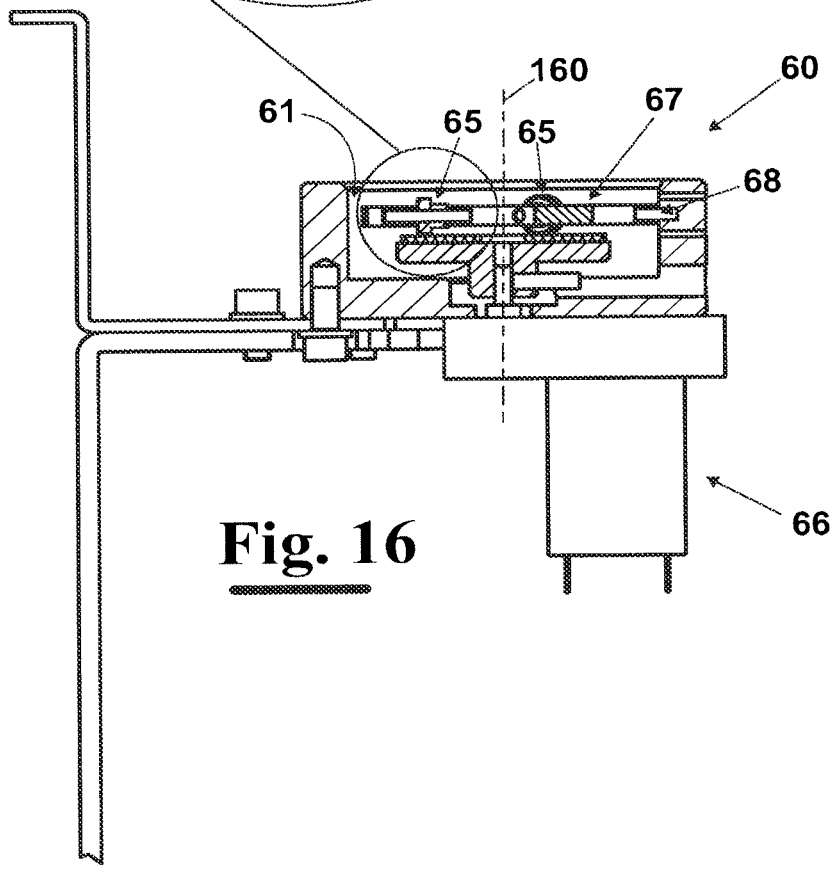
FIG. 16 shows a cross sectional view of the spatial orientation computing device of the support body of FIG. 14.

The means for transmitting the movement of the gear motor 66 to the rollers 65 can provide, as shown in detail in FIG. 17, a rotatable plate 63. The rotation of the plate about an axis 160 causes the rotation of the rollers 65. For example, the or each roller 65 can be pivotally engaged to a pin 69 connected to a plate 67. This is in turn fastened, for example by a bolt 68, to the wall delimiting laterally the housing 61. Therefore, the rotation of plate 63 about its axis 160 causes the rotation of the or each roller 65 about the respective rotation axis 165. For increasing the friction between the plate 63 and the roller 65 it is possible to provide a layer of a high friction material, such as rubber.

Therefore, by knowing the angular position of the rollers 65 the spatial orientation of the support body 10 is determined and, in particular, the angular position of each suction hole 18 present on it is known. This makes it possible to arrange precisely the support body 10 by the handling device 40 at the application station of the abrasive sheet 25, and, in particular to cause the suction holes 18 of the support body 10 to overlap the suction holes 28 of the abrasive sheets 25 housed within the container 75.

To assist the relative positioning of the support body 10 and the stack of abrasive sheets 25 in container 75, it is possible to provide a reference element, in particular a reference bolt 78. For example, the reference element 78 is arranged to engage with one of the holes 18 of the support body 10, in order to keep the support body 10 to a correct position during the approaching movement of the stack of sheets 25 and the following application of an abrasive sheet 25 on the surface 15.

In case of a sanding machine of roto-orbital type the support body 10, in addition to rotate about its own axis 110, moves along an orbital eccentric path with respect to the axis 150 of the working head 50 of the handling device 40 to which it is constrained.

Figure 5:
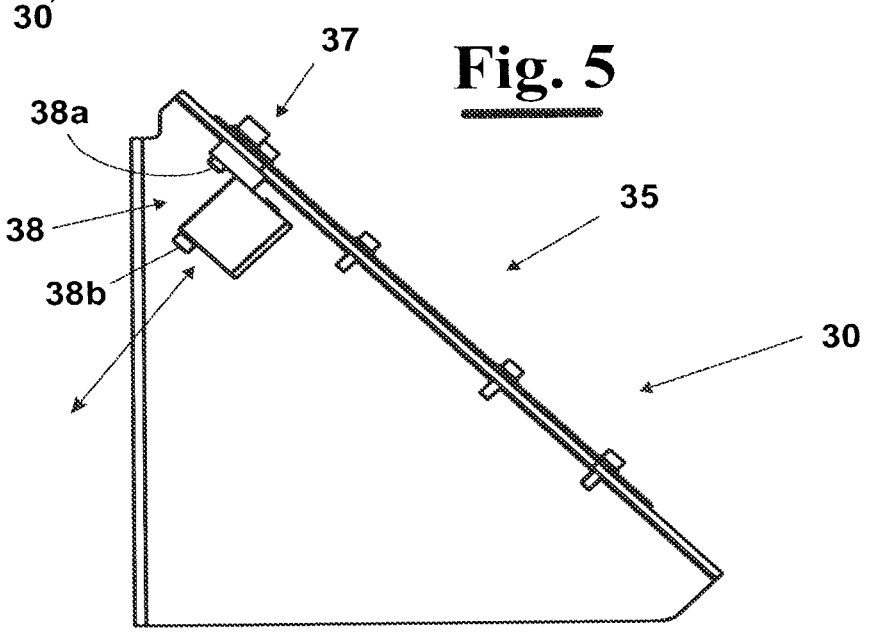
Figure 7:
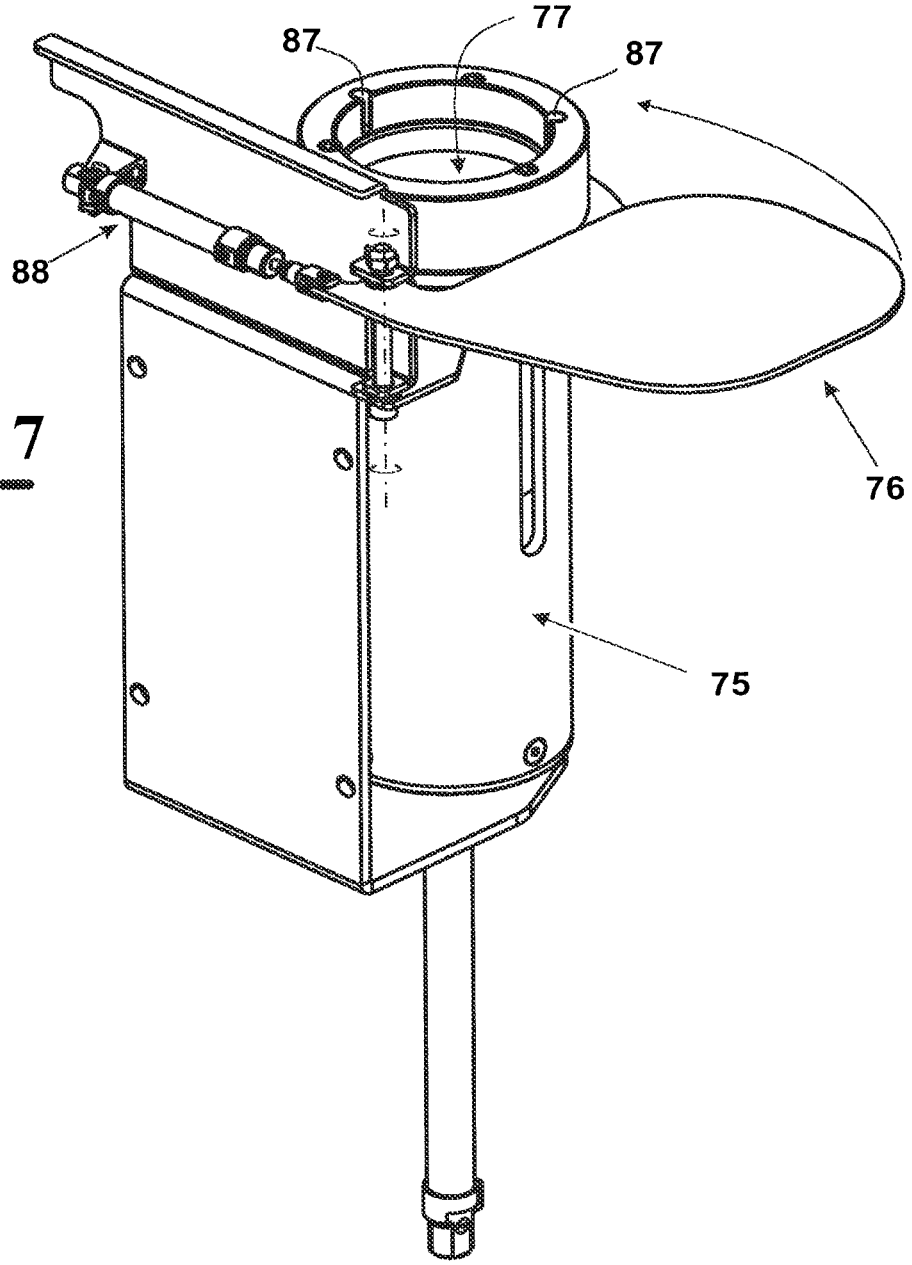
FIGS. 7 and 8 show in a perspective rear view and in a perspective front view, respectively, a container of abrasive sheets for highlighting some technical features.
Figure 8:
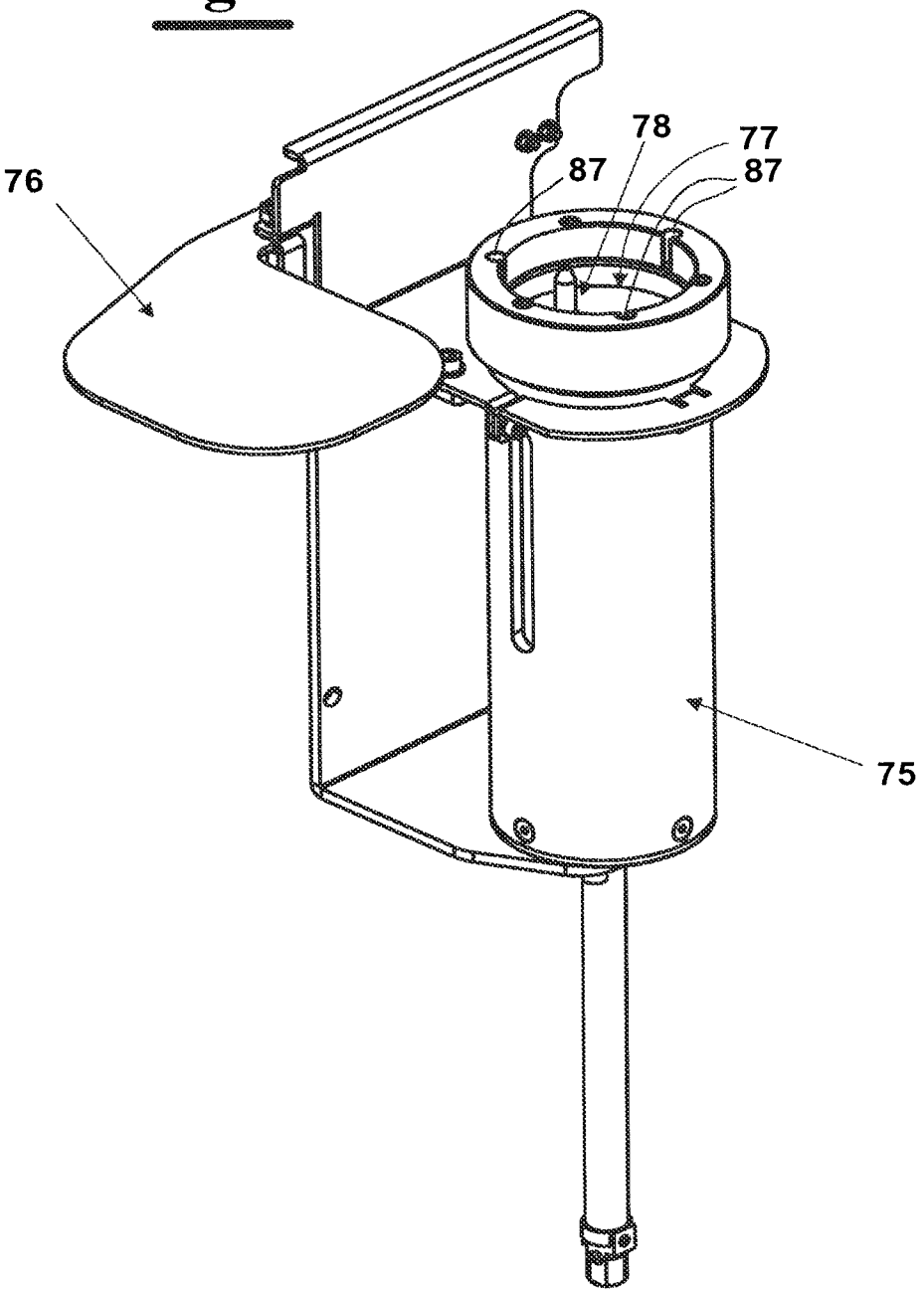

The detection device 36 above described with reference to FIGS. 5, 6 and 7, can be used both for testing the correct removal of the abrasive sheet 25 from the engagement surface 15 of the support body 10 and to check the successful application of the abrasive sheet 25 to the engagement surface 15 and then to test the correct removal carried out by removal station 30 and the correct application in the application station 70.

Therefore, in this case, a device can be provided for computing the position of the rotation axis 110 of the support body 10, for determining the position of the axis 110 in space and then execute the different operations with high precision.

In an exemplary embodiment of the invention, the axis 150 of the working head 50 has a 'known position, and so it is enough to know the relative position of the axis 110 of the support body 10 from axis 150. Therefore, in this case, the device for computing the position of the axis 110 can be arranged to determine the distance of the axis 110 from the axis of the working head 50.

Figure 18:
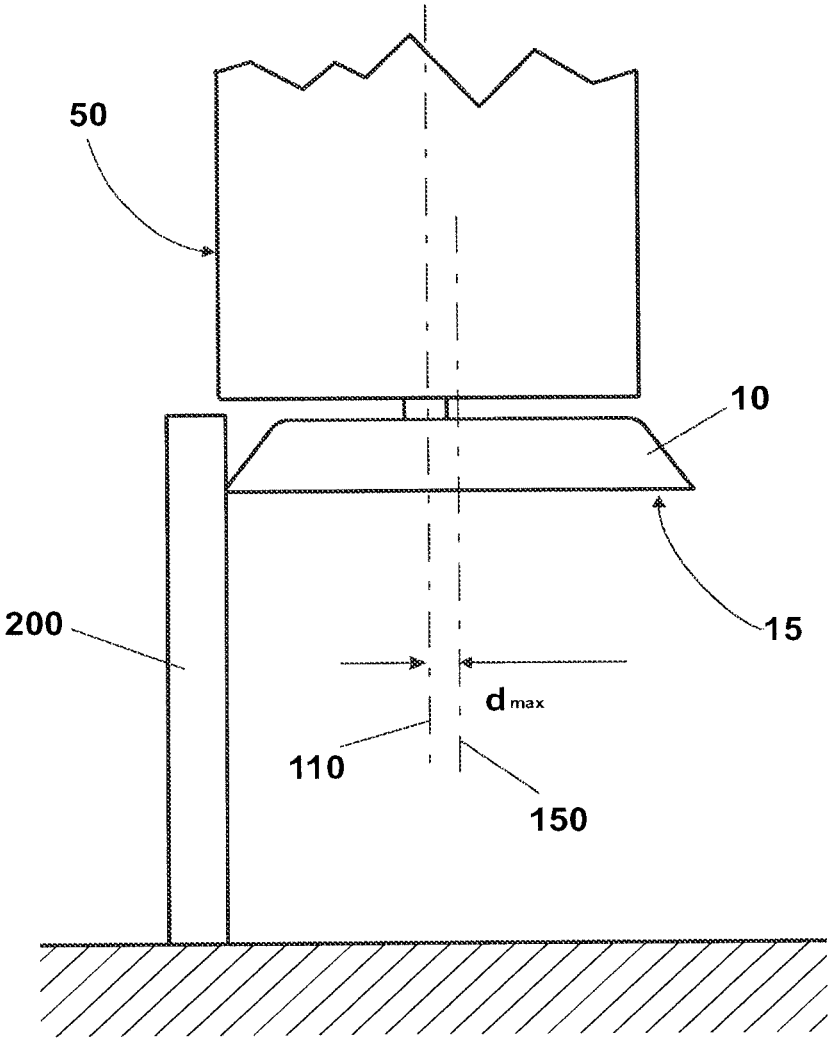
FIG. 18 diagrammatically shows an elevational front view of a device, according to the invention, for computing the space position of the axis of the support body.

An example of the process through which it is possible to determine the position of the axis 110 with respect to the axis 150 is shown in FIG. 18. In this case, the handling device 40 is arranged to actuate the working head 50, and then the support body 10 to it constrained, in order to bring the axis 110 of the support body 10 to a known position, for example at a maximum distance from the axis 150. This can be made by the handling device 40, for example by forcing the support body 10 against a wall 200 up to maximize the distance from axis 150. In fact, by knowing the eccentricity of the support body, i.e. a maximum distance dmax of the axis 110 from axis 150, and by knowing the position of the latter, it is possible to determine the spatial position of the axis 110.

Notwithstanding the abrasive sheet shown in FIGS. 1 to 18 is substantially circular, i.e. It is an abrasive disc, this structure is to be intended as an exemplary one, since it is possible to use the apparatus, according to the present invention, for replacing abrasive sheets with different shape, for example rectangular.

The foregoing description of specific exemplary embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. A system for changing an abrasive sheet in a sanding machine comprising:

a sanding machine having a support body with an engagement surface arranged to engage with the abrasive sheet and a handling device for handling spatially the support body according to at least two degrees of freedom;

a removal station having a gripping element configured to grip the abrasive sheet in order to disengage the abrasive sheet from the support body; and a computing device to compute the spatial orientation of the support body, and the handling device arranged to bring the support body to a position having a known spatial orientation, wherein the support body comprises one or more suction holes and the handling device is arranged to position the support body at the computing device for computing the orientation, with the support body free to rotate about a rotation axis, the computing device including an actuator arranged to cause a rotation of the support body about the rotation axis to place the support body in the position having known spatial orientation, the actuator arranged to transmit movement to one or more rollers positioned at a radial distance from the rotation axis corresponding to a radial distance of said one or more suction holes.

2. The system of claim 1, wherein the removal station includes a detection device that detects the presence of the abrasive sheet on the engagement surface of the support body.

3. The system of claim 2, wherein the detection device is a sensor of color recognition of an abrasive side of the abrasive sheet, which is of a color different from the engagement surface of the support body.

4. The system of claim 2, wherein the detection device is a diffuse-type laser sensor.

5. The system of claim 1, wherein the removal station includes an edge to disengage the abrasive sheet on the engagement surface of the support body.

6. The system of claim 5, wherein the edge is a sharp edge.

7. The system of claim 6, wherein the handling device is arranged to actuate the support body with respect to the removal station to bring the support body to a removal position in which the sharp edge of the removal device is located between the abrasive sheet and the support body to detach at least a portion of the abrasive sheet from the engagement surface.

8. The system of claim 1, further comprising at least one application station having a container for storing a new abrasive sheet.

9. The system of claim 8, wherein the handling device positions the support body at the container to engage the new abrasive sheet with the engagement surface of the support body.

10. The system of claim 9, wherein the container of the at least one application station includes a push element to push the new abrasive sheet against the engagement surface of the support body when positioned at the container to assist the engagement of the abrasive sheet with the engagement surface.

11. The system of claim 1, wherein the support body includes at least one main suction hole in pneumatic connection with an air suction system to remove dust and fragments from the working surface.

12. A method for changing an abrasive sheet in a sanding machine, the method comprising:

providing a sanding machine including:

a support body comprising one or more suction holes and having an engagement surface arranged to engage with the abrasive sheet, the support body being free to rotate about a rotation axis, and a handling device configured to handle spatially the support body according to at least two degrees of freedom;

providing a removal station having a gripping element configured to grip the abrasive sheet to disengage the abrasive sheet from the support body;

providing a computing device including an actuator arranged to cause a rotation of the support body about the rotation axis, moving the support body with the handling device with respect to the removal device to place the support body in a removal position in which the gripping element disengages at least one portion of the abrasive sheet from the engagement surface;

positioning, using the handling device, the support body at the computing device and computing the spatial orientation of the support body, placing, using the handling device, the support body into a position having a known spatial orientation, based on the computed spatial orientation, by using the actuator to transmit movement to one or more rollers positioned at a radial distance from the rotation axis corresponding to a radial distance of said one or more suction holes.

13. The method of claim 12, further comprising detecting the presence of the abrasive sheet with a detection device.

14. The method of claim 12, further comprising controlling the presence of the abrasive sheet on the engagement surface of the support body.

15. The method of claim 14, further comprising positioning the support body, using the handling device, at an application station having a container for storing a new abrasive sheet to engage the new abrasive sheet with the engagement surface of the support body.

* * * * *